US006083899A

United States Patent [19]

Baker et al.

[11] Patent Number: 6,083,899

[45] Date of Patent: Jul. 4, 2000

[54] FABRIC SOFTENERS HAVING INCREASED PERFORMANCE

[75] Inventors: Ellen Schmidt Baker; Frederick Anthony Hartman; Errol Hoffman Wahl, all of Cincinnati, Ohio; Mark Robert Sivik, Ft. Mitchell, Ky.; Lucille Florence Taylor, Middletown, Ohio

[73] Assignee: The Procter & Gamble Company, Cincinnati, Ohio

[21] Appl. No.: 09/269,087

[22] PCT Filed: Sep. 19, 1997

[86] PCT No.: PCT/US97/16688

§ 371 Date: Mar. 18, 1999

§ 102(e) Date: Mar. 18, 1999

[87] PCT Pub. No.: WO98/12292

PCT Pub. Date: Mar. 26, 1998

Related U.S. Application Data

[60] Provisional application No. 60/026,442, Sep. 19, 1996.

[51] Int. Cl.[7] ..... C11D 1/645

[52] U.S. Cl. ..... 510/515; 510/504; 510/521

[58] Field of Search ..... 510/515, 521, 510/504

[56] References Cited

U.S. PATENT DOCUMENTS

| | | | |
|---|---|---|---|
| 3,904,533 | 9/1975 | Neiditch et al. | 252/8.8 |
| 3,915,867 | 10/1975 | Kang et al. | 252/8.8 |
| 4,399,045 | 8/1983 | Burns | 252/8.75 |
| 4,401,578 | 8/1983 | Verbruggen | 252/8.8 |
| 4,767,547 | 8/1988 | Straathof et al. | 252/8.8 |
| 4,772,404 | 9/1988 | Fox et al. | 252/8.8 |
| 4,808,321 | 2/1989 | Walley | 252/8.8 |
| 5,066,414 | 11/1991 | Chang | 252/8.8 |
| 5,460,736 | 10/1995 | Trinh et al. | 252/8.8 |
| 5,674,832 | 10/1997 | Keys | 510/504 |
| 5,958,858 | 9/1999 | Bettiol et al. | 510/351 |

FOREIGN PATENT DOCUMENTS

| | | |
|---|---|---|
| 111984 A2 | 6/1984 | European Pat. Off. . |
| 0 240727 | 10/1987 | European Pat. Off. . |
| 0 243735 | 11/1987 | European Pat. Off. . |
| 0 336267 | 10/1989 | European Pat. Off. . |
| 0 346634 | 11/1989 | European Pat. Off. . |
| 0 409502 | 1/1991 | European Pat. Off. . |
| 2-139480 | 11/1988 | Japan . |
| 1-249129 | 10/1989 | Japan . |
| 4-333667 | 11/1992 | Japan . |
| WO 89/11522 | 11/1989 | WIPO . |

*Primary Examiner*—John R. Hardee
*Attorney, Agent, or Firm*—Richard S. Echler, Sr.; Kim W. Zerby; Jacobus C. Rasser

[57] ABSTRACT

The present invention relates to fabric softener compositions having enhanced softening benefits comprising a fabric softener active in combination with a cationic charge booster. The cationic charge boosters of the present invention are suitable for use with any fabric softener active, preferably with diester and diamide quaternary ammonium (DEQA) compounds.

13 Claims, No Drawings

FABRIC SOFTENERS HAVING INCREASED PERFORMANCE

This application claims the benefit of U.S. Provisional No. 60/026,442 filed Sep. 19, 1996.

FIELD OF THE INVENTION

The present invention relates to fabric softener compositions wherein the performance of the fabric softener active is enhanced by the presence of a cationic charge booster. The present invention also relates to methods for providing enhanced fabric conditioning benefits to fabric by contacting said fabric with a composition comprising a quaternary ammonium fabric softener active and one or more cationic charge boosting compounds.

BACKGROUND OF THE INVENTION

Consumers have come to expect clean, freshened, static-free, cling-free fabric after the laundry cycle. Fabric softeners, whether added at the laundry rinse stage or at the automatic dryer stage, have become a means for providing fabric, especially clothing, with direct enhancement of these properties. One important class of fabric softener actives comprises Diester and Diamide Quaternary Ammonium (DEQA) compounds which typically can comprise mono-, di-, or tri-functional amines (e.g. diethanol amine) which are converted to the corresponding esters or amides then fully or partially quaternized. Manipulation of the acyl moiety combined with the mono-, di-, or tri-functional amines have led to DEQA's which are effective fabric softener active suitable for use in dryer added or rinse added fabric softener compositions. However, some cationic fabric softening actives perform in some ways less well than others.

Accordingly, there remains a need in the art for cationic fabric softener compositions which have an increased or "boosted" fabric softening capacity. In addition, fabric softener compositions which comprise fabric softener actives having suitable properties other than sufficient cationic charge density, need a means to boost the overall charge density thereby providing to the consumer a better fabric care benefit.

BACKGROUND ART

The following relate to fabric softening and fabric enhancement. U.S. Pat. No. 3,915,867, Kang et al., issued Oct. 28, 1975; U.S. Pat. No. 3,904,533, Neiditch et al. issued Sep. 9, 1975; U.S. Pat. No. 4,401,578, Verbruggen, issued Aug. 30, 1983; U.S. Pat. No. 4,767,547, Straathof et al., issued Aug. 30, 1988; U.S. Pat. No. 4,808,321, Walley, issued Feb. 28, 1989; U.S. Pat. No. 5,066,414, Chang, issued Nov. 19, 1991; Japanese Patent Application 63-194316, filed Nov. 21, 1988; Japanese Laid Open Publication 1,249,129, filed Oct. 4, 1989; Japanese Patent Application 4-333,667, published Nov. 20, 1992; EP 243,735; EP 336,267-A with a priority of Apr. 2, 1988; European Patent Application 243,735, Nusslein et al., published Nov. 4, 1987; European Patent Application 409,502, Tandela et al., published Jan. 23, 1991; European Patent Application 240,727, Nusslein et al., priority date of Mar. 12, 1986; and WO 89/11522-A (DE 3,818,061-A; EP-346,634-A), with a priority of May 27, 1988.

SUMMARY OF THE INVENTION

It has now been surprisingly discovered that the addition of certain cationic charge enhancing agents will sufficiently increase the performance of cationic fabric softener actives having diminished or insufficient charge density, to a level which allows the low charge density active to be used in fabric softening formulations. In addition, it has been surprisingly found that when cationic charge boosters are used in conjunction with Diester or Diamide Quaternary Ammonium (DEQA) compounds, these preferred fabric softening actives are enhanced even further.

The cationic charge enhancing agents of the present invention have the effect of increasing the net cationic charge concentration independent of the intrinsic properties of the softener active. Therefore, the formulator may combine fabric softener actives having low cationic charge capacity, but which have other desirable properties inter alia good dispensability, low melting point, with cationic charge boosters thereby obtaining a composition which overcomes the lack of cationic charge density of the fabric softener active.

The first aspect of the present invention relates to fabric softener compositions comprising:

a) at least about 2%, preferably from about 2%, more preferably from about 5% to about 60%, more preferably to about 40% by weight, of a fabric softening active having the formula:

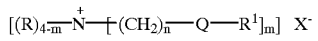

wherein each R is independently $C_1$–$C_6$ alkyl, $C_1$–$C_6$ hydroxyalkyl, benzyl, and mixtures thereof; $R^1$ is $C_1$–$C_{22}$ alkyl, $C_3$–$C_{22}$ alkenyl, and mixtures thereof; Q is a carbonyl moiety having the formula:

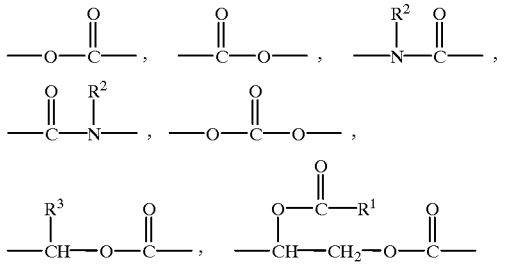

wherein $R^2$ is hydrogen, $C_1$–$C_4$ alkyl, $C_1$–$C_4$ hydroxyalkyl, and mixtures thereof; $R^3$ is hydrogen, $C_1$–$C_4$ alkyl, and mixtures thereof; X is a softener compatible anion; m is from 1 to 3; n is from 1 to 4;

b) at least one cationic charge booster selected from the group consisting of:

i) at least about 0.2%, preferably from about 0.2% to about 10%, more preferably from about 0.2% to about 6% by weight, of a cationic charge booster having the formula:

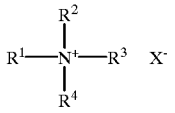

wherein $R^1$, $R^2$, $R^3$ and $R^4$ are each independently $C_1$–$C_{22}$ alkyl, $C_3$–$C_{22}$ alkenyl. $R^5$—Q—$(CH_2)_m$—, wherein $R^5$ is $C_1$–$C_{22}$ alkyl, $C_3$–$C_{22}$ alkenyl, and mixtures thereof, m is from 1 to about 6; Q is a carbonyl unit as defined hereinabove; X is a softener compatible anion;

ii) at least about 0.2%, preferably from about 0.2% to about 5%, more preferably from about 0.2% to about 2% by weight, of a cationic charge booster having the formula:

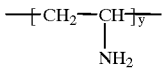

wherein each —$NH_2$ unit hydrogen is optionally substituted by an alkyleneoxy unit having the formula:

$$-(R^1O)_xR^2$$

wherein $R^1$ is $C_2$–$C_4$ alkylene, $R^2$ is hydrogen, $C_1$–$C_4$ alkyl, and mixtures thereof; x is from 1 to 50; y is from 3 to about 10,000;

iii) at least about 0.2%, preferably from about 0.2% to about 10%, more preferably from about 0.2% to about 5% by weight, of a cationic charge booster having the formula:

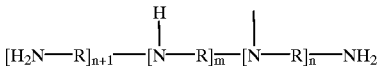

wherein R is $C_2$–$C_6$ alkylene, m is from about 3 to about 70, n is from 0 to about 35; wherein each hydrogen atom of said backbone is optionally substituted by an alkyleneoxy unit having the formula:

$$-(R^1O)_xR^2$$

wherein $R^1$ is $C_2$–$C_4$ alkylene, $R^2$ is hydrogen, $C_1$–$C_4$ alkyl, and mixtures thereof; x is from 1 to 50;

iv) at least about 0.2%, preferably from about 0.2% to about 10%, more preferably from about 0.2% to about 6% by weight, of a cationic charge booster having the formula:

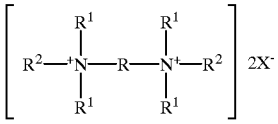

wherein R is substituted or unsubstituted $C_2$–$C_{12}$ alkylene, substituted or unsubstituted $C_2$–$C_{12}$ hydroxyalkylene; each $R^1$ is independently $C_1$–$C_4$ alkyl, each $R^2$ is independently $C_1$–$C_{22}$ alkyl, $C_3$–$C_{22}$ alkenyl, $R^5$—Q—$(CH_2)_m$—, wherein $R^5$ is $C_1$–$C_{22}$ alkyl, $C_3$–$C_{22}$ alkenyl, and mixtures thereof; m is from 1 to about 6; Q is a carbonyl unit as defined hereinabove; and mixtures thereof; X is a softener compatible anion; and v) mixtures thereof; and c) the balance carriers and adjunct ingredients, said adjunct ingredients selected from the group consisting of nonionic fabric softening agents, concentration aid, soil release agent, perfume, preservatives, stabilizers, colorants, optical brighteners, opacifiers, fabric conditioning agents, anti-shrinkage agents, anti-wrinkle agents, fabric crisping agents, spotting agents, germicides, fungicides, anti-corrosion agents, antifoam agents, and mixtures thereof.

The present invention further relates to methods for boosting the cationic charge of fabric softening compositions by adding one or more charge boosting components. These and other objects, features and advantages will become apparent to those of ordinary skill in the art from a reading of the following detailed description and the appended claims.

All percentages, ratios and proportions herein are by weight, unless otherwise specified. All temperatures are in degrees Celsius (°C.) unless otherwise specified. All documents cited are in relevant part, incorporated herein by reference.

DETAILED DESCRIPTION OF THE INVENTION

The present invention relates to improving the softening capacity of fabric softener actives, preferably Diester and Diamide Quaternary Ammonium (DEQA) fabric softening actives. Without wishing to be limited by theory it has been surprisingly discovered that the performance of fabric softener actives can be further enhanced by combining said actives with certain cationic charge boosters. The effect is to increase the overall charge density of the total softener composition. Among the compounds suitable for use as cationic charge boosters are compounds having pre-formed cations (i.e. quaternary ammonium compounds) while others (i.e. ethoxylated polyethyleneimines) form the cationic charge booster in situ during storage or during use.

Quaternary Ammonium Fabric Softening Active Compounds (DEQA)

The preferred fabric softening actives according to the present invention have the formula:

wherein each R is independently $C_1$–$C_6$ alkyl, $C_1$–$C_6$ hydroxyalkyl, benzyl, and mixtures thereof; $R^1$ is preferably $C_{11}$–$C_{22}$ alkyl, $C_{11}$–$C_{22}$ alkenyl, and mixtures thereof; Q is a carbonyl moiety having the formula:

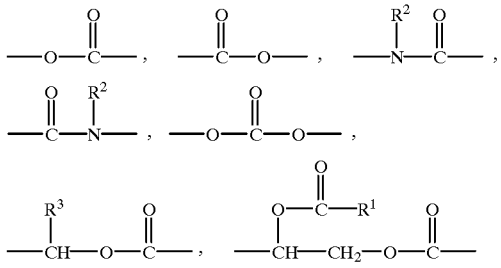

wherein $R^2$ is hydrogen, $C_1$–$C_4$ alkyl, preferably hydrogen; $R^3$ is $C_1$–$C_4$ alkyl, preferably hydrogen or methyl; preferably Q has the formula:

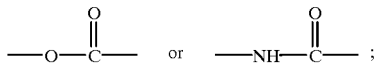

X is a softener compatible anion, preferably the anion of a strong acid, for example, chloride, bromide, methylsulfate, ethylsulfate, sulfate, nitrate and mixtures thereof, more preferably chloride and methyl sulfate. The anion can also, but less preferably, carry a double charge, in which case $X^{(-)}$ represents half a group. The index m has a value of from 1 to 3; the index n has a value of from 1 to 4, preferably 2 or 3, more preferably 2.

More preferred softener actives according to the present invention have the formula:

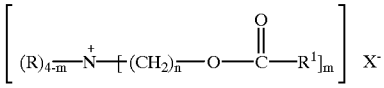

wherein the unit having the formula:

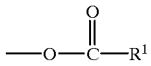

is a fatty acyl moiety. Suitable fatty acyl moieties for use in the softener actives of the present invention are derived from sources of triglycerides including tallow, vegetable oils and/or partially hydrogenated vegetable oils including inter alia canola oil, safflower oil, peanut oil, sunflower oil, corn oil, soybean oil, tall oil, rice bran oil.

The $R^1$ units are typically mixtures of linear and branched chains of both saturated and unsaturated aliphatic fatty acids, an example of which (canola oil), is described in Table I herein below.

TABLE I

| Fatty acyl unit | % |
|---|---|
| C14 | 0.1 |
| C16 | 5.4 |
| C16:1 | 0.4 |
| C18 | 5.7 |
| C18:1 | 67.0 |
| C18:2 | 13.5 |
| C18:3 | 2.7 |
| C20 | 0.5 |
| C20:1 | 4.6 |

The formulator, depending upon the desired physical and performance properties of the final fabric softener active, can choose any of the above mentioned sources of fatty acyl moieties, or alternatively, the formulator can mix sources of triglyceride to form a "customized blend". However, those skilled in the art of fats and oils recognize that the fatty acyl composition may vary, as in the case of vegetable oil, from crop to crop, or from variety of vegetable oil source to variety of vegetable oil source. DEQA's which are prepared using fatty acids derived from natural sources are preferred.

A preferred embodiment of the present invention provides softener actives comprising $R^1$ units which have at least about 3%, preferably at least about 5%, more preferably at least about 10%, most preferably at least about 15% $C_{11}$–$C_{22}$ alkenyl, including polyalkenyl (polyunsaturated) units inter alia oleic, linoleic, linolenic.

For the purposes of the present invention the term "mixed chain fatty acyl units" is defined as "a mixture of fatty acyl units comprising alkyl and alkenyl chains having from 10 carbons to 22 carbon atoms including the carbonyl carbon atom, and in the case of alkenyl chains, from one to three double bonds, preferably all double bonds in the cis configuration". With regard to the $R^1$ units of the present invention, it is preferred that at least a substantial percentage of the fatty acyl groups are unsaturated, e.g., from about 25%, preferably from about 50% to about 70%, preferably to about 65%. The total level of fabric softening active containing polyunsaturated fatty acyl groups can be from about 3%, preferably from about 5%, more preferably from about 10% to about 30%, preferably to about 25%, more preferably to about 18%. As stated herein above cis and trans isomers can be used, preferably with a cis/trans ratio is of from 1:1, preferably at least 3:1, and more preferably from about 4:1 to about 50:1, more preferably about 20:1, however, the minimum being 1:1.

The $R^1$ units suitable for use in the present invention can be further characterized by the Iodine Value (IV) of the parent fatty acid, said IV is preferably from about 20, more preferably from about 50, most preferably from about 70, to a value of about 140, preferably to about 130, more preferably to about 115. However, formulators, depending upon which embodiment of the present invention they choose to execute, may wish to add an amount of fatty acyl units which have Iodine Values outside the range listed herein above. For example, "hardened stock" (IV less than or equal to about 10) may be combined with the source of fatty acid admixture to adjust the properties of the final softener active. A further preferred embodiment of the present invention comprises DEQA's wherein the average Iodine Value for $R^1$ is approximately 45.

Amines which are used to prepare the preferred fabric softening actives of the present invention have the formula:

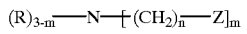

wherein R is the same as defined herein above; each Z is independently selected from the group consisting of —OH, —$CHR^3OH$, —$CH(OH)CH_2OH$, —$NH_2$, and mixtures thereof; preferably —OH, —$NH_2$, and mixtures thereof; $R^3$ is $C_1$–$C_4$ alkyl, preferably methyl; the indices m and n are the same as defined hereinabove.

Non-limiting examples of preferred amines which are used to form the DEQA fabric softening actives according to the present invention include methyl bis(2-hydroxyethyl) amine having the formula:

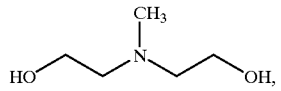

methyl bis(2-hydroxypropyl)amine having the formula:

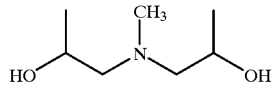

methyl (3-aminopropyl) (2-hydroxyethyl)amine having the formula:

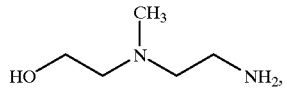

methyl bis(2-aminoethyl)amine having the formula:

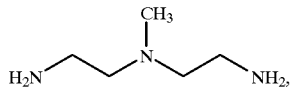

triethanol amine having the formula:

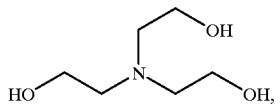

bis(2-aminoethyl) ethanolamine having the formula:

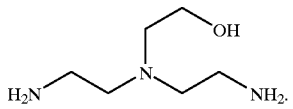

For the purposes of the present invention, R moieties which are introduced during the quaternization step are preferably methyl. In the case of amines having the formula:

$$R—N—[(CH_2)_n—Q—R^1]_2$$

R is preferably the same moiety (i.e. methyl) which is introduced during the quaternization step. For example, a methyl amine having the formula:

$$CH_3—N—[(CH_2)_n—Q—R^1]_2.$$

is preferably quaternized to the softener active having the general formula:

$$[(CH_3)_2—\overset{+}{N}—[(CH_2)_n—Q—R^1]_2]\ X^-.$$

In one embodiment of the present invention, the fabric softening active precursor amine mixture is not fully quaternized, that is, some free amine having the general formula:

$$(R)_{3-m}—N—[(CH_2)_n—Q—R^1]_m$$

is still present in the final fabric softener mixture.

A yet further embodiment of the present invention comprises an amine of the formula:

$$(R)_{3-m}—N—[(CH_2)_n—Z]_m$$

wherein not all of the Z units are fully reacted with a fatty acyl moiety thereby leaving an amount of amine and/or quaternized ammonium compound in the final fabric softener active admixture having one or more Z units unreacted and thereby not transformed into an ester or amide.

The following are examples of preferred softener actives according to the present invention.

N,N-di(tallowyl-oxy-ethyl)-N,N-dimethyl ammonium chloride;

N,N-di(canolyl-oxy-ethyl)-N,N-dimethyl ammonium chloride;

N,N-di(tallowyl-oxy-ethyl)-N-methyl, N-(2-hydroxyethyl) ammonium chloride;

N,N-di(canolyl-oxy-ethyl)-N-methyl, N-(2-hydroxyethyl) ammonium chloride;

N,N-di(2-tallowyloxy-2-oxo-ethyl)-N,N-dimethyl ammonium chloride;

N,N-di(2-canolyloxy-2-oxo-ethyl)-N,N-dimethyl ammonium chloride

N,N-di(2-tallowyloxyethylcarbonyloxyethyl)-N,N-dimethyl ammonium chloride;

N,N-di(2-canolyloxyethylcarbonyloxyethyl)-N,N-dimethyl ammonium chloride;

N-(2-tallowoyloxy-2-ethyl)-N-(2-tallowyloxy-2-oxo-ethyl)-N,N-dimethyl ammonium chloride;

N-(2-canolyloxy-2-ethyl)-N-(2-canolyloxy-2-oxo-ethyl)-N,N-dimethyl ammonium chloride;

N,N,N-tri(tallowyl-oxy-ethyl)-N-methyl ammonium chloride;

N,N,N-tricanolyl-oxy-ethyl)-N-methyl ammonium chloride;

N-(2-tallowyloxy-2-oxoethyl)-N-(tallowyl)-N,N-dimethyl ammonium chloride;

N-(2-canolyloxy-2-oxoethyl)-N-(canolyl)-N,N-dimethyl ammonium chloride;

1,2-ditallowyloxy-3-N,N,N-trimethylammoniopropane chloride; and 1,2-dicanolyloxy-3-N,N,N-trimethylammoniopropane chloride;

and mixtures of the above actives.

Particularly preferred is N,N-di(tallowoyl-oxy-ethyl)-N,N-dimethyl ammonium chloride, where the tallow chains are at least partially unsaturated and N,N-di(canoloyl-oxy-ethyl)-N,N-dimethyl ammonium chloride.

The amount of fabric softening active present in the compositions of the present invention is at least about 2%, preferably from about 2%, more preferably from about 5% to about 60%, more preferably to about 40% by weight, of the composition.

Cationic Charge Boosters

The preferred cationic charge boosters of the present invention are described herein below.

i) Quaternary Ammonium Compounds

A preferred composition of the present invention comprises at least about 0.2%, preferably from about 0.2% to about 10%, more preferably from about 0.2% to about 5% by weight, of a cationic charge booster having the formula:

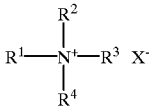

wherein $R^1$, $R^2$, $R^3$, and $R^4$ are each independently $C_1$–$C_{22}$ alkyl, $C_3$–$C_{22}$ alkenyl, $R^5$—Q—$(CH_2)_m$—, wherein $R^5$ is $C_1$–$C_{22}$ alkyl, and mixtures thereof, m is from 1 to about 6; X is an anion.

Preferably $R^1$ is $C_6$–$C_{22}$ alkyl, $C_6$–$C_{22}$ alkenyl, and mixtures thereof, more preferably $C_{11}$–$C_{18}$ alkyl, $C_{11}$–$C_{18}$ alkenyl, and mixtures thereof; $R^2$, $R^3$, and $R^4$ are each preferably $C_1$–$C_4$ alkyl, more preferably each $R^2$, $R^3$, and $R^4$ are methyl.

The formulator may similarly choose $R^1$ to be a $R^5$—Q—$(CH_2)_m$— moiety wherein $R^5$ is an alkyl or alkenyl moiety having from 1 to 22 carbon atoms, preferably the alkyl or alkenyl moiety when taken together with the Q unit is an acyl unit derived preferably derived from a source of triglyceride selected from the group consisting of tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures thereof.

An example of a fabric softener cationic booster comprising a $R^5$—Q—$(CH_2)_m$— moiety has the formula:

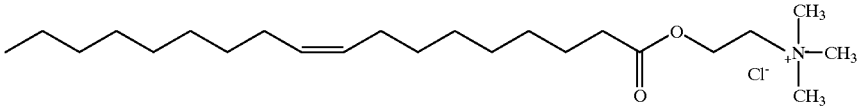

wherein $R^5$—Q— is an oleoyl units and m is equal to 2.

X is a softener compatible anion, preferably the anion of a strong acid, for example, chloride, bromide, methylsulfate, ethylsulfate, sulfate, nitrate and mixtures thereof, more preferably chloride and methyl sulfate.

ii) Polyvinyl Amines

A preferred composition according to the present invention contains at least about 0.2%, preferably from about 0.2% to about 5%, more preferably from about 0.2% to about 2% by weight, of one or more polyvinyl amines having the formula

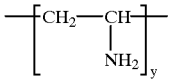

wherein y is from about 3 to about 10,000, preferably from about 10 to about 5,000, more preferably from about 20 to about 500. Polyvinyl amines suitable for use in the present invention are available from BASF.

Optionally, one or more of the polyvinyl amine backbone —$NH_2$ unit hydrogens can be substituted by an alkyleneoxy unit having the formula:

$$—(R^1O)_xR^2$$

wherein $R^1$ is $C_2$–$C_4$ alkylene, $R^2$ is hydrogen, $C_1$–$C_4$ alkyl, and mixtures thereof; x is from 1 to 50. In one embodiment or the present invention the polyvinyl amine is reacted first with a substrate which places a 2-propyleneoxy unit directly on the nitrogen followed by reaction of one or more moles of ethylene oxide to form a unit having the general formula:

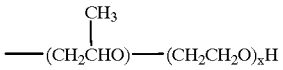

wherein x has the value of from 1 to about 50. Substitutions such as the above are represented by the abbreviated formula PO—$EO_X$—. However, more than one propyleneoxy unit can be incorporated into the alkyleneoxy substituent.

Polyvinyl amines are especially preferred for use as cationic charge booster in liquid fabric softening compositions since the greater number of amine moieties per unit weight provides substantial charge density. In addition, the cationic charge is generated in situ and the level of cationic charge can be adjusted by the formulator.

iii) Polyalkyleneimines

A preferred composition of the present invention comprises at least about 0.2%, preferably from about 0.2% to about 10%, more preferably from about 0.2% to about 5% by weight, of a polyalkyleneimine charge booster having the formula:

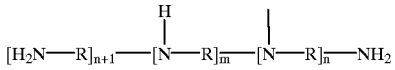

wherein the value of m is from 2 to about 700 and the value of n is from 0 to about 350. Preferably the compounds of the present invention comprise polyamines having a ratio of m:n that is at least 1:1 but may include linear polymers (n equal to 0) as well as a range as high as 10:1, preferably the ratio is 2:1. When the ratio of m:n is 2:1, the of primary:secondary:tertary amine moieties, that is the ratio of —$RNH_2$, —RNH, and —RN moieties, is 1:2:1.

R units are $C_2$–$C_8$ alkylene, $C_3$–$C_8$ alkyl substituted alkylene, and mixtures thereof, preferably ethylene, 1,2-propylene, 1,3-propylene, and mixtures thereof, more preferably ethylene. R units serve to connect the amine nitrogens of the backbone.

Optionally, one or more of the polyvinyl amine backbone —$NH_2$ unit hydrogens can be substituted by an alkyleneoxy unit having the formula:

$$—(R^1O)_xR^2$$

wherein $R^1$ is $C_2$–$C_4$ alkylene, $R^2$ is hydrogen, $C_1$–$C_4$ alkyl, and mixtures thereof; x is from 1 to 50. In one embodiment or the present invention the polyvinyl amine is reacted first with a substrate which places a 2-propyleneoxy unit directly on the nitrogen followed by reaction of one or more moles of ethylene oxide to form a unit having the general formula:

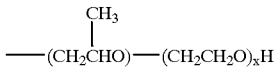

wherein x has the value of from 1 to about 50. Substitutions such as the above are represented by the abbreviated formula PO—$EO_X$—. However, more than one propyleneoxy unit can be incorporated into the alkyleneoxy substituent.

The preferred polyamine cationic charge boosters of the present invention comprise backbones wherein less than 50% of the R groups comprise more than 3 carbon atoms. The use of two and three carbon spacers as R moieties between nitrogen atoms in the backbone is advantageous for controlling the charge booster properties of the molecules. More preferred embodiments of the present invention comprise less than 25% moieties having more than 3 carbon atoms. Yet more preferred backbones comprise less than 10% moieties having more than 3 carbon atoms. Most preferred backbones comprise 100% ethylene moieties.

The cationic charge boosting polyamines of the present invention comprise homogeneous or non-homogeneous polyamine backbones, preferably homogeneous backbones. For the purpose of the present invention the term "homogeneous polyamine backbone" is defined as a polyamine backbone having R units that are the same (i.e., all ethylene).

However, this sameness definition does not exclude polyamines that comprise other extraneous units comprising the polymer backbone that are present due to an artifact of the chosen method of chemical synthesis. For example, it is known to those skilled in the art that ethanolamine may be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention.

For the purposes of the present invention the term "non-homogeneous polymer backbone" refers to polyamine backbones that are a composite of one or more alkylene or substituted alkylene moieties, for example, ethylene and 1,2-propylene units taken together as R units.

However, not all of the suitable charge booster agents belonging to this category of polyamine comprise the above described polyamines. Other polyamines that comprise the backbone of the compounds of the present invention are generally polyalkyleneamines (PAA's), polyalkyleneimines (PAI's), preferably polyethyleneamine (PEA's), or polyethyleneimines (PEI's). A common polyalkyleneamine (PAA) is tetrabutylenepentamine. PEA's are obtained by reactions involving ammonia and ethylene dichloride, followed by fractional distillation. The common PEA's obtained are triethylenetetramine (TETA) and tetraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372, Dickinson, issued May 14, 1957, which describes the preparation of PEA's.

The PEI's which comprise the preferred backbones of the polyamines of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing PEI's are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951 (all herein incorporated by reference). In addition to the linear and branched PEI's, the present invention also includes the cyclic amines that are typically formed as artifacts of synthesis. The presence of these materials may be increased or decreased depending on the conditions chosen by the formulator.

iv) Poly-Quaternary Ammonium Compounds

A preferred composition of the present invention comprises at least about 0.2%, preferably from about 0.2% to about 10%, more preferably from about 0.2% to about 5% by weight, of a cationic charge booster having the formula:

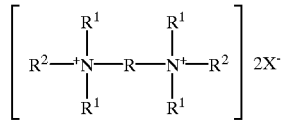

wherein R is substituted or unsubstituted $C_2$–$C_{12}$ alkylene, substituted or unsubstituted $C_2$–$C_{12}$ hydroxyalkylene; each $R^1$ is independently $C_1$–$C_4$ alkyl, each $R^2$ is independently $C_1$–$C_{22}$ alkyl, $C_3$–$C_{22}$ alkenyl, $R^5$—Q—$(CH_2)_m$—, wherein $R^5$ is $C_1$–$C_{22}$ alkyl, $C_3$–$C_{22}$ alkenyl, and mixtures thereof; m is from 1 to about 6; Q is a carbonyl unit as defined hereinabove; and mixtures thereof; X is an anion.

Preferably R is ethylene; $R^1$ is methyl or ethyl, more preferably methyl; at least one $R^2$ is preferably $C_1$–$C_4$ alkyl, more preferably methyl. Preferably at least one $R^2$ is $C_{11}$–$C_{22}$ alkyl, $C_{11}$–$C_{22}$ alkenyl, and mixtures thereof.

The formulator may similarly choose $R^2$ to be a $R^5$—Q—$(CH_2)_m$— moiety wherein $R^5$ is an alkyl moiety having from 1 to 22 carbon atoms, preferably the alkyl moiety when taken together with the Q unit is an acyl unit derived preferably derived from a source of triglyceride selected from the group consisting of tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures thereof.

An example of a fabric softener cationic booster comprising a $R^5$—Q—$(CH_2)_m$— moiety has the formula:

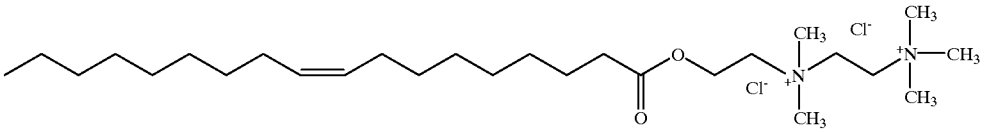

wherein $R^1$ is methyl, one $R^2$ units is methyl and the other $R^2$ unit is $R^5$—Q—$(CH_2)_m$— wherein $R^5$—Q— is an oleoyl unit and m is equal to 2.

X is a softener compatible anion, preferably the anion of a strong acid, for example, chloride, bromide, methylsulfate, ethylsulfate, sulfate, nitrate and mixtures thereof, more preferably chloride and methyl sulfate.

ADJUNCT INGREDIENTS

The following are non-limiting examples of adjunct ingredients which are suitable for use in the fabric softening compositions of the present invention.

Soil Release Agents

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10.0%, by weight, of the detergent compositions herein, typically from about 0.1% to about 5%, preferably from about 0.2% to about 3.0%.

The following, all included herein by reference, describe soil release polymers suitable for use in the present invention. U.S. Pat. No. 3,959,230 Hays, issued May 25, 1976; U.S. Pat. No. 3,893,929 Basadur, issued Jul. 8, 1975; U.S. Pat. No. 4,000,093, Nicol, et al., issued Dec. 28, 1976; U.S. Pat. No. 4,702,857 Gosselink, issued Oct. 27, 1987; U.S. Pat. No. 4,968,451, Scheibel et al., issued November 6; U.S. Pat. No. 4,702,857, Gosselink, issued Oct. 27, 1987; U.S. Pat. No. 4,711,730, Gosselink et al., issued Dec. 8, 1987; U.S. Pat. No. 4,721,580, Gosselink, issued Jan. 26, 1988; U.S. Pat. No. 4,877,896, Maldonado et al., issued Oct. 31, 1989; U.S. Pat. No. 4,956,447, Gosselink et al., issued Sep. 11, 1990; U.S. Pat. No. 5,415,807 Gosselink et al., issued May 16, 1995; European Patent Application 0 219 048, published Apr. 22, 1987 by Kud, et al.

Further suitable soil release agents are described in U.S. Pat. No. 4,201,824, Violland et al.; U.S. Pat. No. 4,240,918 Lagasse et al.; U.S. Pat. No. 4,525,524 Tung et al.; U.S. Pat. No. 4,579,681, Ruppert et al.; U.S. Pat. No. 4,240,918; U.S. Pat. No. 4,787,989; U.S. Pat. No. 4,525,524; EP 279,134 A, 1988, to Rhone-Poulenc Chemie; EP 457,205 A to BASF (1991); and DE 2,335,044 to Unilever N. V., 1974 all incorporated herein by reference.

Commercially available soil release agents include the METOLOSE SM100, METOLOSE SM200 manufactured by Shin-etsu Kagaku Kogyo K. K., SOKALAN type of material, e.g., SOKALAN HP-22, available from BASF (Germany), ZELCON 5126 (from Dupont) and MILEASE T (from ICI).

Perfumes

The products herein can also contain from about 0.5% to about 60%, preferably from about 1% to about 50%, cyclodextrin/perfume inclusion complexes and/or free perfume, as disclosed in U.S. Pat. Nos. 5,139,687, Borcher et al., issued Aug. 18, 1992; and 5,234,610, Gardlik et al., to issue Aug. 10, 1993, which are incorporated herein by reference. Perfumes are highly desirable, can usually benefit from protection, and can be complexed with cyclodextrin. Fabric softening products typically contain perfume to provide an olfactory aesthetic benefit and/or to serve as a signal that the product is effective.

The optional perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Many of the art recognized perfume compositions are relatively substantive to maximize their odor effect on substrates. However, it is a special advantage of perfume delivery via the perfume/cyclodextrin complexes that nonsubstantive perfumes are also effective.

If a product contains both free and complexed perfume, the escaped perfume from the complex contributes to the overall perfume odor intensity, giving rise to a longer lasting perfume odor impression.

As disclosed in U.S. Pat. No. 5,234,610, Gardlik/Trinh/Banks/Benvegnu, issued Aug. 3, 1993, said patent being incorporated herein by reference, by adjusting the levels of free perfume and perfume/CD complex it is possible to provide a wide range of unique perfume profiles in terms of timing (release) and/or perfume identity (character). Solid, dryer-activated fabric conditioning compositions are a uniquely desirable way to apply the cyclodextrins, since they are applied at the very end of a fabric treatment regimen when the fabric is clean and when there are almost no additional treatments that can remove the cyclodextrin.

Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and more preferably from about 0.01% to about 0.2% for reductive agents. These assure good odor stability under long term storage conditions for the compositions and compounds stored in molten form. The use of antioxidants and reductive agent stabilizers is especially critical for low scent products (low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox S-1; a mixture of BHT (butylated hydroxytoluene), BHA (butylated hydroxyanisole), propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1I/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1,1-diphosphonic acid (etidronic acid), and Tiron®, available from Kodak with a chemical name of 4,5-dihydroxy-m-benzenesulfonic acid/sodium salt, EDDS, and DTPA®, available from Aldrich with a chemical name of diethylenetriaminepentaacetic acid.

Concentration Aids

Concentrated compositions of the present invention may require organic and/or inorganic concentration aids to go to even higher concentrations and/or to meet higher stability standards depending on the other ingredients. Surfactant concentration aids are typically selected from the group consisting of single long chain alkyl cationic surfactants; nonionic surfactants; amine oxides; fatty acids; or mixtures thereof, typically used at a level of from 0 to about 15% of the composition.

Inorganic viscosity/dispersibility control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Other Adjunct Ingredients

The present invention can include other adjunct components (minor components) conventionally used in textile treatment compositions, for example, colorants, preservatives, optical brighteners, opacifiers, anti-shrinkage agents, anti-wrinkle agents, fabric crisping agents, spotting agents, germicides, fungicides, anti-corrosion agents, anti-foam agents, and the like.

For examples of other suitable ingredients useful in fabric softener containing compositions see WO 97/03169 included herein by reference.

The following compositions illustrate the present invention.

| | Weight % | | | |
|---|---|---|---|---|
| Ingredients | 1 | 2 | 3 | 5 |
| DEQA[1] | 26.0 | 25.7 | 26.0 | 30.0 |
| MAQ[2] | — | — | — | — |
| PVAm-23K[3] | 2.0 | — | — | — |
| PVAm-1.2K[4] | — | 1.0 | — | — |
| Polyethylenediamine[5] | — | — | 2.0 | — |
| MADQ[6] | — | — | — | 2.4 |
| Ethanol | 2.2 | 2.4 | 2.2 | 2.6 |
| Hexylene glycol | 2.6 | 2.3 | 2.6 | 2.6 |
| 1,2-Hexanediol | 17.0 | — | 17.0 | — |
| TMPD[7] | — | 11.9 | — | 12.0 |
| CHDM[8] | — | 5.0 | — | 48.1 |
| Water | 52.5 | 53.6 | 52.5 | 48.1 |
| Minors[8] | balance | balance | balance | balance |

[1]N,N-di(canoyloxyethyl)-N-2-hydroxyethyl-N-methyl ammonium methyl sulfate available from Witco.
[2]Monocanolyl trimethyl ammonium chloride, available as Adogen 417 ® from Witco.
[3]Polyvinylamine having a MW = 23,000 available from BASF.
[4]Polyvinylamine having a MW = 1,500 available from BASF.
[5]Ethoxylated polyethyleneimine having a backbone average molecular weight of 1800 and an average of 1 ethyleneoxy unit substitutent per N-H backbone unit (PEI 1800 E1), added as a 10% aqueous solution acidified to pH 3 with conc. HCl.
[6]Monotallowyl diquat., available as Adogen 277 ® from Witco.
[7]Trimethyl pnetanediol available from Eastman Chemical.
[8]1,4-cyclohexane dimethanol available from Eastman Chemical.
[9]Minors can include perfume, dye, acid, preservatives, etc.

What is claimed is:

1. A fabric softener composition comprising:

a) from about 2% to about 40% by weight, of a quaternary ammonium fabric softening compound having the formula:

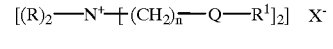

wherein Q is a carbonyl unit hating the formula:

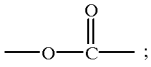

R is methyl; each $R^1$ unit is independently linear or branched $C_{11}$–$C_{22}$ alkyl, linear or branched $C_{11}$–$C_{22}$ alkenyl, and mixtures thereof; X is chloro, —$O_3SOCH_3$, and mixtures thereof;

b) from about 0.2% by weight, of a cationic charge booster having the formula:

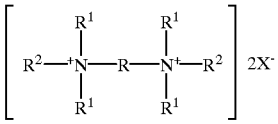

wherein R is substituted or unsubstituted $C_2$–$C_{12}$ alkylene, substituted or unsubstituted $C_2$–$C_{12}$ hydroxyalkylene; each $R^1$ is independently $C_1$–$C_4$ alkyl, each $R^2$ is independently $C_1$–$C_{22}$ alkyl, $C_3$–$C_{22}$ alkenyl, $R^5$—Q—$(CH_2)_m$—, wherein $R^5$ is $C_1$–$C_{22}$ alkyl, and mixtures thereof; m is from 1 to about 6; Q is a carbonyl unit as defined hereinabove; and mixtures thereof; X is a softener compatible anion; and c) the balance carriers and adjunct ingredients.

2. A composition according to claim 1 wherein said R unit in (a) is methyl, hydroxyethyl, and mixtures thereof.

3. A composition according to claim 1 wherein n is equal to 2.

4. A composition according to claim 1 wherein $R^1$ units in (a) are derived from tallow, canola oil, and mixtures thereof.

5. A composition according to claim 1 wherein each R unit in (a) is independently methyl, hydroxyethyl, and mixtures thereof; and Q has the formula:

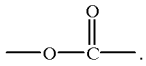

6. A composition according to claim 1 wherein X is —$O_3SOCH_3$.

7. A composition according to claim 1 further comprising from about 0.2% by weight, of one or more charge booster s selected from:

i) cationic charge boosters having the formula:

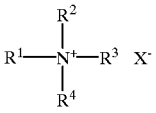

wherein $R^1$, $R^2$, $R^3$, and $R^4$ are each independently $C_1$–$C_{22}$ alkyl, $C_3$–$C_{22}$ alkenyl, $R^5$—Q—$(CH_2)_m$—, wherein $R^5$ is $C_1$–$C_{22}$ alkyl, $C_3$–$C_{22}$ alkenyl and mixtures thereof, m is from 1 to about 6; Q is a carbonyl unit as defined hereinabove; X is an anion;

ii) cationic charge boosters having the formula:

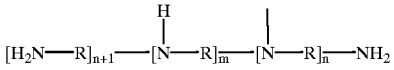

wherein R is $C_2$–$C_6$ alkylene, m is from about 2 to about 70, n is from 0 to about 35; wherein each hydrogen atom of said backbone is optionally substituted by an alkyleneoxy unit having the formula:

$$-(R^1O)_xR^2$$

wherein $R^1$ is $C_2$–$C_4$ alkylene, $R^2$ is hydrogen, $C_1$–$C_4$ alkyl, and mixtures thereof; x is from 1 to 50; and iii) mixtures thereof.

8. A composition according to claim 1 further comprising from about 0.2% to about 2% by weight, of a cationic charge booster having the formula:

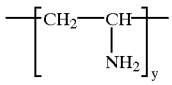

wherein each —$NH_2$ unit hydrogen is optionally substituted by an alkyleneoxy unit having the formula:

$$-(R^1O)_xR^2$$

wherein $R^1$ is $C_2$–$C_4$ alkylene, $R^2$ is hydrogen, $C_1$–$C_4$ alkyl, and mixtures thereof; x is from 1 to 50; y is from 3 to about 10,000.

9. A composition according to claim 1 wherein the $R^1$ units in (b) are derived from a triglyceride source selected from the group consisting of canola oil, tallow, and mixtures thereof.

10. A composition according to claim 1 wherein said $R^2$ in (b) is $R^5$—Q—$(CH_2)_m$—, wherein $R^5$ is $C_1$–$C_{22}$ alkyl, and mixtures thereof; m is from 1 to about 6; Q is a carbonyl unit as defined hereinabove.

11. A composition according to clam 10 wherein $R^2$ in (b) has the formula:

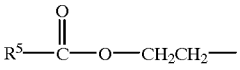

wherein $R^5$ is derived from canola oil, tallow, and mixtures thereof.

12. A composition according to claim 1 wherein said adjunct ingredients selected from the group consisting of nonionic fabric softening agents, concentration aid, soil release agent, perfume, preservatives, stabilizers, colorants, optical brighteners, opacifiers, fabric conditioning agents, anti-shrinkage agents, anti-wrinkle agents, fabric crisping agents, spotting agents, germicides, fungicides, anti-corrosion agents, antifoam agents, and mixtures thereof.

13. A method for providing fabric care benefits and fabric softness to fabric comprising the step of contacting a fabric with a fabric conditioning composition comprising:

a) from about 2% to about 40% by weight, of a quaternary ammonium fabric softening compound having the formula:

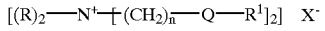

wherein Q is a carbonyl unit having the formula:

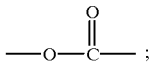

R is methyl; each $R^1$ unit is independently linear or branched $C_{11}$–$C_{22}$ alkyl, linear or branched $C_{11}$–$C_{22}$ alkenyl, and mixtures thereof; X is chloro, —$O_3SOCH_3$, and mixtures thereof;

b) from about 0.2% by weight, of a cationic charge booster having the formula:

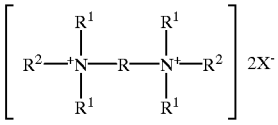

wherein R is substituted or unsubstituted $C_2$–$C_{12}$ alkylene, substituted or unsubstituted $C_2$–$C_{12}$ hydroxyalkylene; each $R^1$ is independently $C_1$–$C_4$ alkyl, each $R^2$ is independently $C_1$–$C_{22}$ alkyl, $C_3$–$C_{22}$ alkenyl, $R^5$—Q—$(CH_2)_m$—, wherein $R^5$ is $C_1$–$C_{22}$ alkyl, and mixtures thereof; m is from 1 to about 6; Q is a carbonyl unit as defined hereinabove; and mixtures thereof; X is a softener compatible anion; and c) the balance carriers and adjunct ingredients.

* * * * *